US011686229B2

(12) United States Patent
Kuroda et al.

(10) Patent No.: US 11,686,229 B2
(45) Date of Patent: Jun. 27, 2023

(54) ENGINE, OUTBOARD MOTOR AND BOAT

(71) Applicant: Honda Motor Co., Ltd., Tokyo (JP)

(72) Inventors: Tatsuya Kuroda, Wako (JP); Takanori Sato, Wako (JP); Atsushi Murao, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/592,457

(22) Filed: Feb. 3, 2022

(65) Prior Publication Data

US 2022/0251985 A1 Aug. 11, 2022

(30) Foreign Application Priority Data

Feb. 8, 2021 (JP) ..... JP2021-017894

(51) Int. Cl.

| | |
|---|---|
| ***F01M 13/00*** | (2006.01) |
| ***F01M 11/00*** | (2006.01) |
| ***F02B 75/22*** | (2006.01) |
| ***B63H 20/02*** | (2006.01) |
| ***F01M 11/02*** | (2006.01) |

(52) U.S. Cl.

CPC ..... *F01M 13/00* (2013.01); *B63H 20/02* (2013.01); *F01M 11/0004* (2013.01); *F01M 11/02* (2013.01); *F02B 75/22* (2013.01); *F01M 2013/0038* (2013.01)

(58) Field of Classification Search

CPC .... F01M 13/00; F01M 11/0004; F01M 11/02; F01M 2013/0038; B63H 20/02; B63H 20/24; B63H 20/28

See application file for complete search history.

(56) References Cited

U.S. PATENT DOCUMENTS

2005/0005895 A1* 1/2005 Fukuda ..... F02B 61/045 123/196 W
2007/0240692 A1* 10/2007 Takahashi ..... F02B 61/045 123/196 R

FOREIGN PATENT DOCUMENTS

JP H08334010 A 12/1996
JP H11301592 A 11/1999
JP 2002242643 * 8/2002

OTHER PUBLICATIONS

Japanese Office action; Application 2021-017894; dated Sep. 6, 2022.

* cited by examiner

*Primary Examiner* — Syed O Hasan
(74) *Attorney, Agent, or Firm* — Duft & Bornsen, PC

(57) ABSTRACT

Engine includes: crankcase housing crankshaft extending in vertical direction; cylinder block mounted on side of crankcase and formed with cylinder; cylinder head mounted on side of cylinder block and provided with air inlet port and air outlet port communicating with cylinder; cylinder head cover mounted on side of cylinder head and covering air inlet port and air outlet port; mount case including: supporting portion provided below crankcase and cylinder block and supporting crankcase and cylinder block; and extending portion extending from supporting portion below cylinder head and cylinder head cover; oil pan provided below mount case and storing lubricating oil; and communication tube communicating first space formed between cylinder head and cylinder head cover and second space formed between mount case and oil pan. Communication tube is provided between cylinder head cover and extending portion.

9 Claims, 5 Drawing Sheets

ENGINE, OUTBOARD MOTOR AND BOAT

CROSS-REFERENCE TO RELATED APPLICATION

This application is based upon and claims the benefit of priority from Japanese Patent Application No. 2021-017894 filed on Feb. 8, 2021, the content of which is incorporated herein by reference.

BACKGROUND OF THE INVENTION

Field of the Invention

This invention relates to an engine, an outboard motor, and a boat.

Description of the Related Art

Conventionally, there has been known an engine in which blow-by gas flowing into an oil pan from a crank chamber is guided into a cylinder head cover and sent from the cylinder head cover to an air intake device (for example, see Japanese Unexamined Patent Application Publication No. H11-301592 (JPH11-301592A)). In the engine described in JPH11-301592A, the oil pan communicates with the inside of the cylinder head cover via the gas passage penetrating the cylinder body and the cylinder head. Therefore, in the case of an engine having a large output, it is necessary to increase the cross-sectional area of the gas passage, and the engine is increased in size.

SUMMARY OF THE INVENTION

An aspect of the present invention is an engine, including: a crankcase housing a crankshaft extending in a vertical direction; a cylinder block mounted on a side of the crankcase and formed with a cylinder; a cylinder head mounted on a side of the cylinder block and provided with an air inlet port and an air outlet port communicating with the cylinder; a cylinder head cover mounted on a side of the cylinder head and covering the air inlet port and the air outlet port; a mount case including: a supporting portion provided below the crankcase and the cylinder block and supporting the crankcase and the cylinder block; and an extending portion extending from the supporting portion below the cylinder head and the cylinder head cover; an oil pan provided below the mount case and storing lubricating oil; and a communication tube communicating a first space formed between the cylinder head and the cylinder head cover and a second space formed between the mount case and the oil pan. The communication tube is provided between the cylinder head cover and the extending portion.

Another aspect of the present invention is an outboard motor, including: the engine; and a propeller driven by the engine to rotate.

Another aspect of the present invention is a boat, including: the outboard motor; and a hull mounted with the outboard motor.

BRIEF DESCRIPTION OF THE DRAWINGS

The objects, features, and advantages of the present invention will become clearer from the following description of embodiments in relation to the attached drawings, in which.

DETAILED DESCRIPTION OF THE INVENTION

Figure 1:
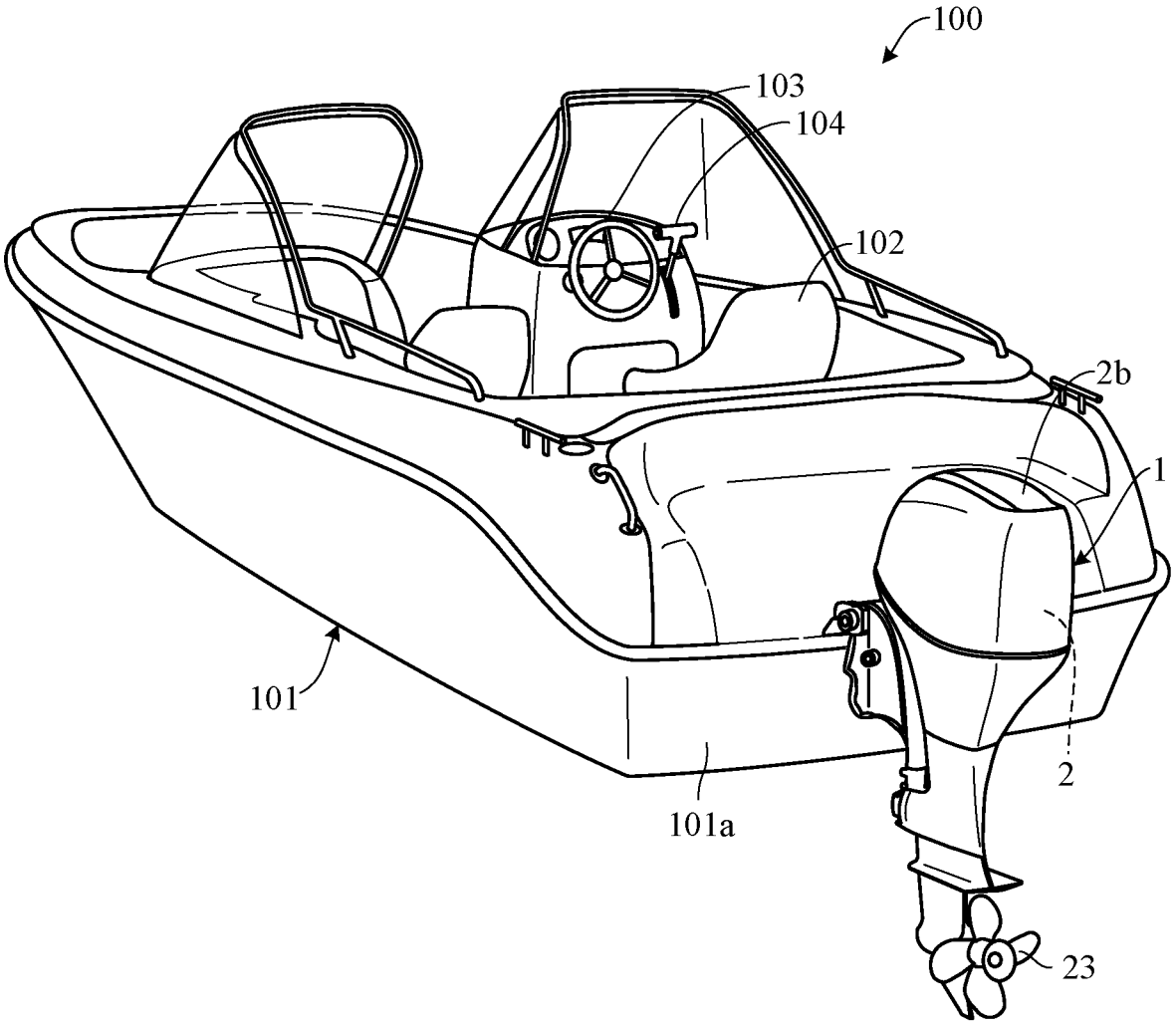
FIG. 1 is a perspective view schematically illustrating a boat on which an outboard motor according to an embodiment of the present invention is mounted.

Hereinafter, an embodiment of the present invention will be described with reference to FIGS. 1 to 5. FIG. 1 is a perspective view schematically illustrating a boat 100 on which an outboard motor 1 according to an embodiment of the present invention is mounted. As illustrated in FIG. 1, the outboard motor 1 is attached as a power source to a stern of a hull 101 of the boat 100 such as a small boat, and is driven in response with an operation of a boat operator to propel the hull 101. A steering wheel 103 and a shift lever (shift/throttle lever) 104 are provided near a cockpit 102 of the hull 101. A shift lever 104 is configured to be swingable in the forward direction or the backward direction from the neutral position, and inputs a switching instruction from the neutral position to the forward or backward direction and an adjustment instruction of the engine rotation speed in response to the operation of the boat operator.

Figure 2:
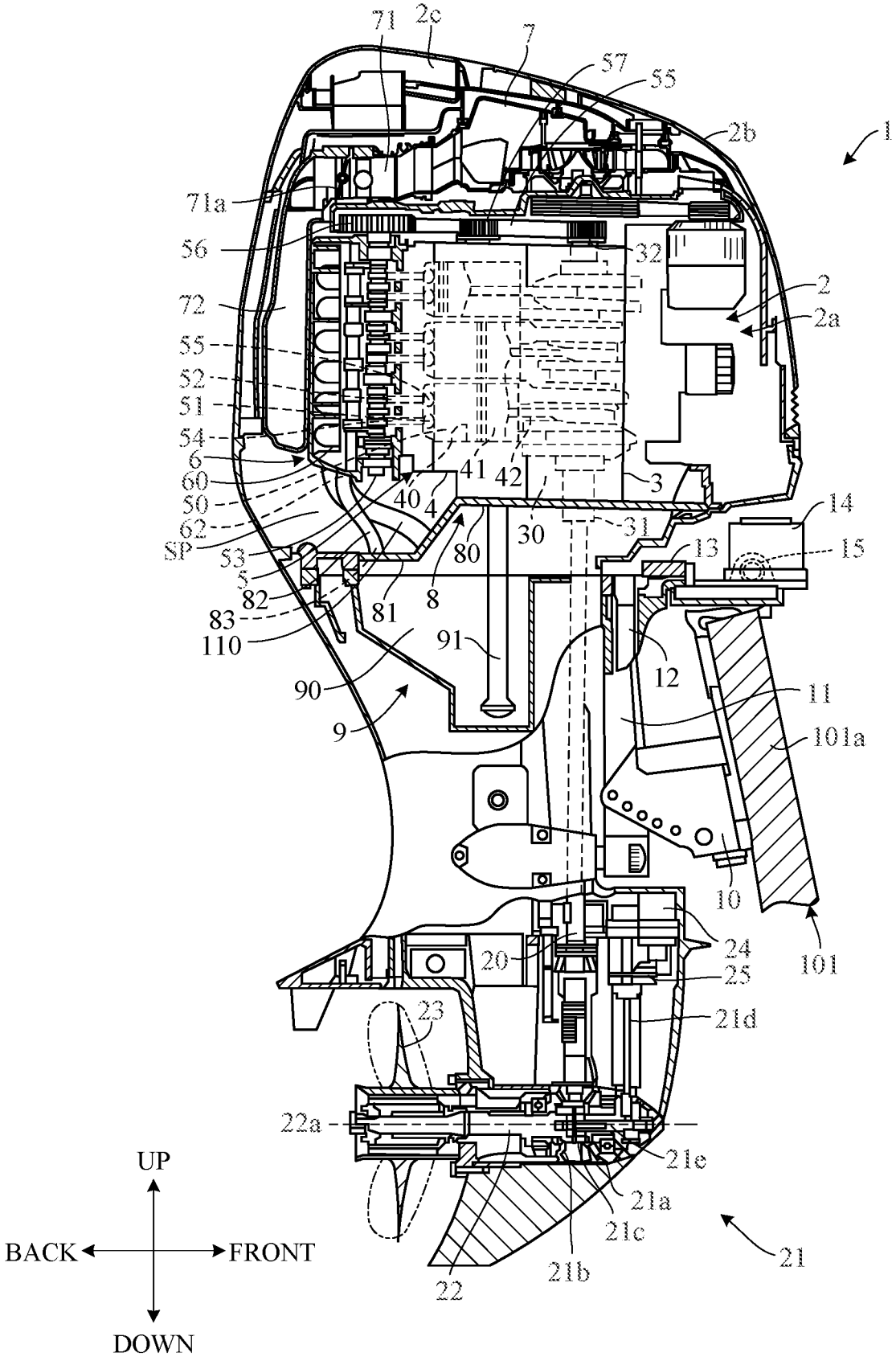
FIG. 2 is a longitudinal cross-sectional view schematically illustrating configuration of a main component of the outboard motor shown in FIG. 1.

FIG. 2 is a longitudinal cross-sectional view schematically illustrating the configuration of a main component of the outboard motor 1. Hereinafter, the up-down direction, the right-left direction, and the front-back direction are defined as illustrated in the figure, and each unit will be described according to this definition.

As illustrated in FIG. 2, the outboard motor 1 is attached to a transom board 101*a* located at the stern of the hull 101 via a stern bracket 10 provided in front. A swivel case 11 is provided behind the stern bracket 10, and a swivel shaft 12 rotatable about a vertical axis is housed in the swivel case 11. The swivel shaft 12 is connected to a steering electric motor 14 via a reduction gear mechanism (not illustrated) and a mount frame 13, and constitutes a steering shaft that steers the hull 101 to the right and left in response to the rotation of the steering electric motor 14.

Power tilt units (not illustrated) for tilting up and tilting down or trimming up and trimming down the outboard motor 1 are provided on both right and left sides of the stern bracket 10. The power tilting unit includes a tilt angle adjustment hydraulic cylinder and a trim angle adjustment hydraulic cylinder, and the swivel case 11 rotates with a tilting shaft 15 as a rotation axis by extending and contracting these hydraulic cylinders. Due to this, the outboard motor 1 is tilted up and tilted down or trimmed up and trimmed down.

An engine 2 is mounted on an upper portion of the outboard motor 1, and the engine 2 is covered with an engine cover 2*b*. A crankshaft 31 of the engine 2 extends in the vertical direction, and the lower end of the crankshaft 31 is connected to the upper end of a drive shaft 20 extending in the vertical direction. The lower end of the drive shaft 20 is connected to one end of a propeller shaft 22 extending in the horizontal direction via a shift mechanism 21, and a propeller 23 is attached to the other end of the propeller shaft 22. The propeller shaft 22 is disposed such that an axis 22*a* becomes substantially parallel to the water surface when the trim angle is the initial angle.

The shift mechanism 21 includes a forward bevel gear 21*a* and a backward bevel gear 21*b* that are connected to the drive shaft 20 and rotate, a clutch 21*c* that engages the propeller shaft 22 with either the forward bevel gear 21*a* or the backward bevel gear 21*b*, a shift rod 21*d*, and a shift slider 21*e*. An output shaft of a shift electric motor 24 that performs a shift change by operating the shift mechanism 21 is connected to the upper end of the shift rod 21*d* via a reduction gear mechanism 25, and the shift slider 21*e* is connected to the lower end of the shift rod 21*d*. When the shift electric motor 24 is driven in response to the operation of the shift lever 104 by the boat operator, the shift rod 21*d* and the shift slider 21*e* are appropriately displaced to operate the clutch 21*c*, and the shift mechanism 21 is switched between neutral, forward, and backward. When the shift mechanism 21 is forward or backward, the rotation of the drive shaft 20 is transmitted to the propeller shaft 22 via the shift mechanism 21, the propeller 23 rotates, and the hull 101 is propelled in the forward direction or the backward direction.

Figure 3:
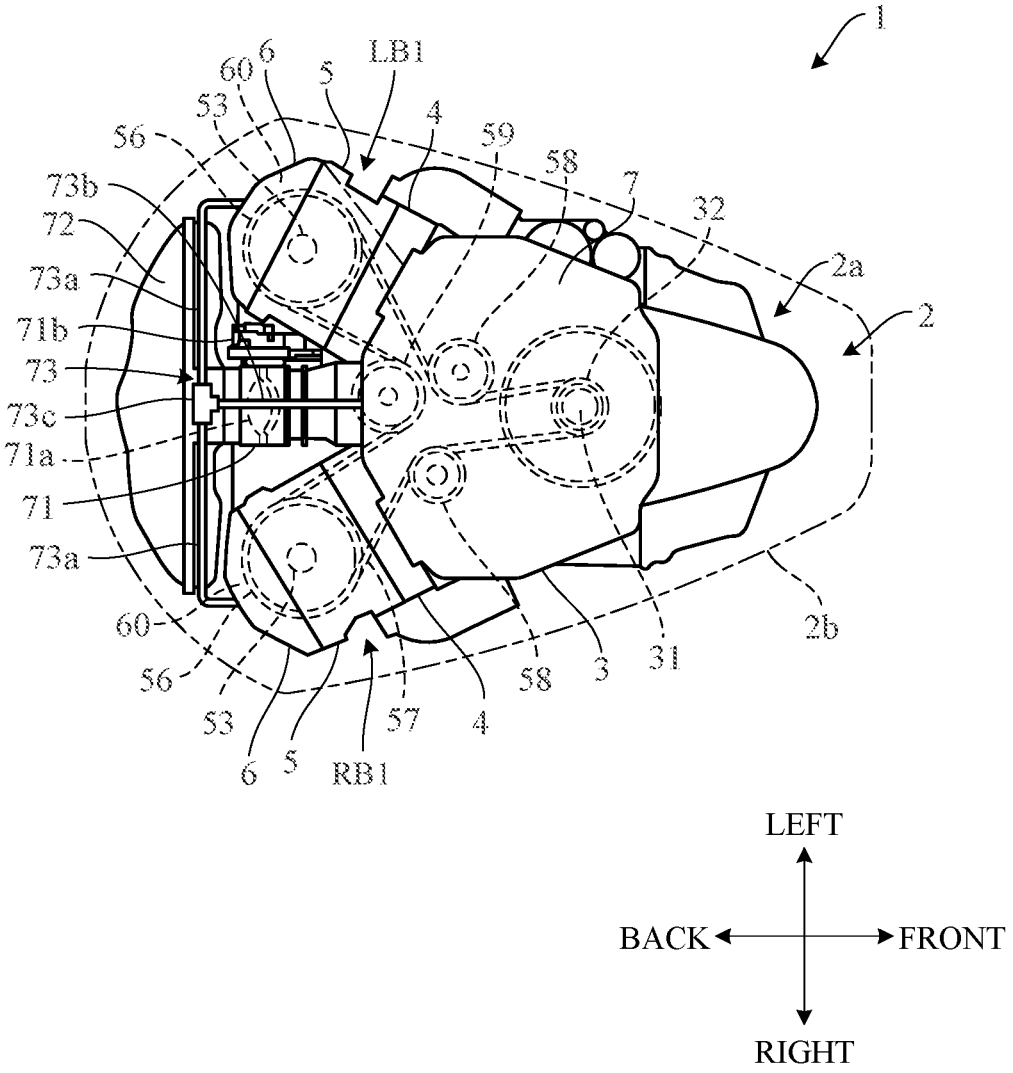
FIG. 3 is a plan view schematically illustrating configuration of a main component of an engine shown in FIG. 2.

FIG. 3 is a plan view schematically illustrating the configuration of a main component of the engine 2. As illustrated in FIGS. 2 and 3, the engine 2 is a V-type multi-cylinder engine in which a pair of banks (cylinder rows) formed by arranging a plurality of cylinders in the up-down direction are arranged in a V shape, and includes a V-type six-cylinder engine having three cylinders in each bank. Hereinafter, the right side bank of the engine 2 is referred to as a first bank RB1, and the left side bank is referred to as a second bank LB1.

The engine 2 includes: a crankcase 3 housing the crankshaft 31 extending in the vertical direction; a cylinder block 4 attached on a side of the crankcase 3 and formed with a cylinder 40; a cylinder head 5 attached on a side of the cylinder block 4 and provided with an air inlet port 51 and an air outlet port 52 communicating with the cylinder 40; and a cylinder head cover 6 attached on a side of the cylinder head 5 and covering the air inlet port 51 and the air outlet port 52. The crankcase 3, the cylinder block 4, the cylinder head 5, and the cylinder head cover 6 constitute an engine body 2*a*. Each of the first bank RB1 and the second bank LB1 includes the cylinder block 4, the cylinder head 5, and the cylinder head cover 6.

The crankcase 3 and the cylinder block 4 constitute a crank chamber 30, and the crankshaft 31 is housed in the crank chamber 30. The lower end of the crankshaft 31 extends downward from the crank chamber 30 and is connected to the upper end of the drive shaft 20. The upper end of the crankshaft 31 extends upward from the crank chamber 30, and a crank pulley 32 is attached thereto.

In the cylinder block 4, three cylinders 40 arranged in the up-down direction are formed in each of the first bank RB1 and the second bank LB1. Each cylinder 40 slidably houses a piston 41, and one end of a connecting rod 42 is coupled to each piston 41. The other end of the connecting rod 42 is coupled to the crankshaft 31, and the piston 41 slides in the cylinder 40 to rotate the crankshaft 31.

The cylinder head 5 and the cylinder block 4 constitute a combustion chamber 50 for each cylinder 40, and the air inlet port 51 and the air outlet port 52 communicate with each combustion chamber 50. A camshaft 53 extending in the vertical direction is rotatably supported on the back side of the cylinder head 5, and the camshaft 53 drives an air intake valve 54 and an air exhaust valve 55 to open and close the air inlet port 51 and the air outlet port 52.

A cam pulley 56 is attached to the upper end of the camshaft 53. A timing belt 57 is wound around the cam pulley 56 and the crank pulley 32, and when the crankshaft 31 rotates, the camshaft 53 also rotates via the timing belt 57. The timing belt 57 is also wound around an idle pulley 58 forming a track of the timing belt 57 and a tensioner pulley 59 that applies predetermined tension to the timing belt 57.

Figure 4:
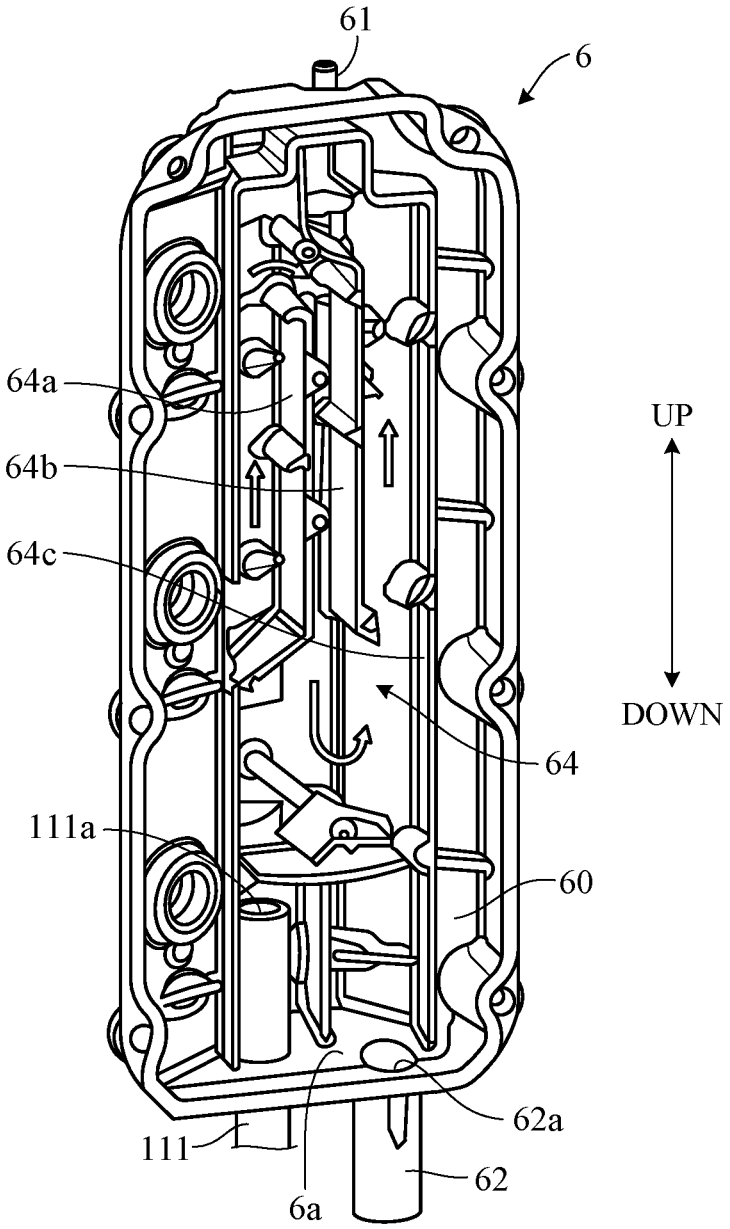
FIG. 4 is a perspective view schematically illustrating an inner side of a cylinder head cover shown in FIG. 2.

The cylinder head cover 6 and the cylinder head 5 constitute a cam chamber 60 that houses the camshaft 53. FIG. 4 is a perspective view schematically illustrating an inner side (cam chamber 60 side) of the cylinder head cover 6. As illustrated in FIG. 4, the cylinder head cover 6 is provided with a first connection portion 61 at an upper portion, a second connection portion 62 at a lower portion, and a gas flow passage (flow passage) 64 through which the blow-by gas introduced via the cylinder block 4, the cylinder head 5, and the like flows inside. A breather tube 73 (FIG. 3) for introducing the blow-by gas in the cam chamber 60 into the air intake device 7 is connected to the first connection portion 61. An oil return tube 82 (FIG. 2) for discharging the oil in the cam chamber 60 to an oil pan 9 (FIG. 2) is connected to the second connection portion 62.

The first connection portion 61 is formed in a tubular shape, and causes the cam chamber 60 inside the cylinder head cover 6 and the inside of the breather tube 73 to communicate with each other in a state where the breather tube 73 is connected. The second connection portion 62 is formed in a tubular shape, and causes the cam chamber 60 inside the cylinder head cover 6 and the inside of the oil return tube 82 to communicate with each other in a state where the oil return tube 82 is connected. The second connection portion 62 is provided such that an upper end 62*a* is positioned on substantially the same plane as a bottom surface 6*a* inside the cylinder head cover 6 (cam chamber 60). This makes it difficult for the oil in the cam chamber 60 to accumulate on the bottom surface 6*a*.

The gas flow passage 64 is formed such that the blow-by gas introduced into the cam chamber 60 via a breather passage (gas passage) not illustrated that is formed in the cylinder block 4, the cylinder head 5, and the like circulates toward the first connection portion 61. Specifically, the gas flow passage 64 includes first to third partition walls 64*a* to 64*c* erected from the inner wall surface of the cylinder head cover 6 in the horizontal direction, and a partition plate (not illustrated), and forms a circulation space through which the blow-by gas circulates.

The first to third partition walls 64*a* to 64*c* each extend in the vertical direction and are provided substantially in parallel to one another. The first partition wall 64*a* is provided such that one wall surface faces the outlet of the breather passage. The blow-by gas introduced into the cam chamber 60 via the breather passage circulates upward along one wall surface of the first partition wall 64*a*. The second partition wall 64*b* is provided such that one wall surface faces the other wall surface of the first partition wall 64*a*. The blow-by gas circulating upward along one wall surface of the first partition wall 64*a* circulates downward along the other wall surface of the first partition wall 64*a* and one wall surface of the second partition wall 64*b*. The third partition wall 64*c* is provided such that one wall surface faces the other wall surface of the second partition wall 64*b*. The blow-by gas circulating downward along the other wall surface of the first partition wall 64*a* and one wall surface of the second partition wall 64*b* circulates upward toward the first connection portion 61 along the other wall surface of the second partition wall 64*b* and one wall surface of the third partition wall 64*c*, and is discharged from the cam chamber 60 via the first connection portion 61.

By configuring the gas flow passage 64 into such a shape, the lubricating oil contained in the blow-by gas is separated by gravity in the process in which the blow-by gas circulates through the gas flow passage 64, and is discharged from the cam chamber 60 via the second connection portion 62. This makes it possible to prevent the lubricating oil contained in the blow-by gas from being introduced into the air intake device 7 via the first connection portion 61 and the breather tube 73 (FIG. 3).

As illustrated in FIGS. 2 and 3, the air intake device 7 is provided above the engine body 2*a*. The air intake device 7 takes in air from the outside via an air introduction portion 2*c* formed in the engine cover 2*b*, and introduces the air into the air inlet port 51 via a throttle body 71 and an intake manifold 72. The throttle body 71 includes a throttle valve 71*a* opened and closed by an actuator, and adjusts the intake amount of the engine 2. The intake manifold 72 connects the throttle body 71 and the air inlet port 51 of each of the banks RB1 and LB1.

The air intake device 7 takes in the blow-by gas discharged from the cam chamber 60 via the breather tube 73, and introduces the blow-by gas into the engine 2 via the throttle body 71 and the intake manifold 72 together with air taken in from the outside via the air introduction portion 2*c*. As illustrated in FIGS. 3 and 4, the breather tube 73 includes a pair of first tubes 73*a* having one end connected to the first connection portion 61 provided in the cylinder head cover 6 of each of the banks RB1 and LB1, a second tube 73*b* having one end connected to the air intake device 7, and a T-joint 73*c* connecting the other end of the pair of first tubes 73*a* and the other end of the second tube 73*b*.

As illustrated in FIG. 2, a mount case 8 that supports the crankcase 3, the cylinder block 4, and the like, and the oil pan 9 that stores lubricating oil for lubricating the inside of the engine 2 (engine body 2*a*) are disposed below the engine body 2*a*. That is, in the engine 2 of the outboard motor 1, the mount case 8 and the oil pan 9 are disposed below the longitudinally mounted engine body 2*a*.

The mount case 8 is interposed between the engine body 2*a* and the oil pan 9. The lower end of the mount case 8 is connected to the upper end of the oil pan 9, and an oil reservoir space 90 for storing lubricating oil is formed below the mount case 8 and above the oil pan 9. The mount case 8 includes a support portion 80 that supports the crankcase 3 and the cylinder block 4, and an extending portion 81 that extends from the support portion 80 to below the cylinder head 5 and the cylinder head cover 6. The crankshaft 31 penetrates the support portion 80. The extending portion 81 is provided with a pair of connection portions 83, and the pair of connection portions 83 is connected with the other ends of a pair of the oil return tubes 82 of which one end is connected to the lower portion (second connection portion 62) of the cylinder head cover 6 of each of the banks RB1 and LB1. Each of the connection portions 83 is formed in a tubular shape, and causes the oil reservoir space 90 below the mount case 8 and the inside of the oil return tube 82 to communicate with each other in a state where the oil return tube 82 is connected. The lubricating oil accumulated on the bottom surface 6*a* (FIG. 4) inside (cam chamber 60) the cylinder head cover 6 of each of the banks RB1 and LB1 is returned to the oil pan 9 via the oil return tube 82 and the extending portion 81 (connection portion 83) of the mount case 8.

The oil pan 9 is provided with an oil pump 91. The oil pump 91 operates, for example, when the crankshaft 31 rotates, and pumps up the lubricating oil stored in the oil pan 9. The lubricating oil pumped up by the oil pump 91 passes through an oil path (not illustrated) formed in the mount case 8, the cylinder block 4, and the cylinder head 5, and is supplied to the bearing portion of the crankshaft 31 and the camshaft 53 and the like.

The exhaust gas generated in the combustion chamber 50 of the engine 2 is normally discharged from the combustion chamber 50 to the outside of the engine 2 via the air outlet port 52 formed in the cylinder head 5. However, the exhaust gas sometimes leaks from the combustion chamber 50 into the crank chamber 30 beyond the sealing capability of a piston ring. The exhaust gas leaking into the crank chamber 30, i.e., the blow-by gas also flows into the oil pan 9 (oil reservoir space 90) together with the lubricating oil. Conventionally, such blow-by gas is guided from the crank chamber 30 and the oil pan 9 (oil reservoir space 90) to the cam chamber 60 inside the cylinder head cover 6 through the breather passage formed in the cylinder block 4, the cylinder head 5, and the like (engine body 2*a*) that are cast components, and is introduced into the air intake device 7 via the breather tube 73.

However, when the breather passage is provided in the engine body 2*a*, the horizontal length of the cylinder block 4 increases, resulting in an increase of the size of the engine 2. In particular, in a case of the engine 2 having a large output, since the blow-by gas also increases, it is necessary to increase the cross-sectional area of the breather passage, which may further increase the size of the engine 2.

Therefore, in the embodiment of the present invention, a breather communication tube (communication tube) directly connecting the cam chamber 60 inside the cylinder head cover 6 of each of the banks RB1 and LB1 and the oil reservoir space 90 below the mount case 8 is provided, and the blow-by gas is directly discharged from the oil reservoir space 90 to the cam chamber 60 of each of the banks RB1 and LB1. Thus, for example, even in the engine 2 having a large output, it is not necessary to increase the cross-sectional area of the breather passage provided in the engine body 2*a*. In other words, it is not necessary to provide a breather passage having a large cross-sectional area in the engine body 2*a*.

Figure 5:
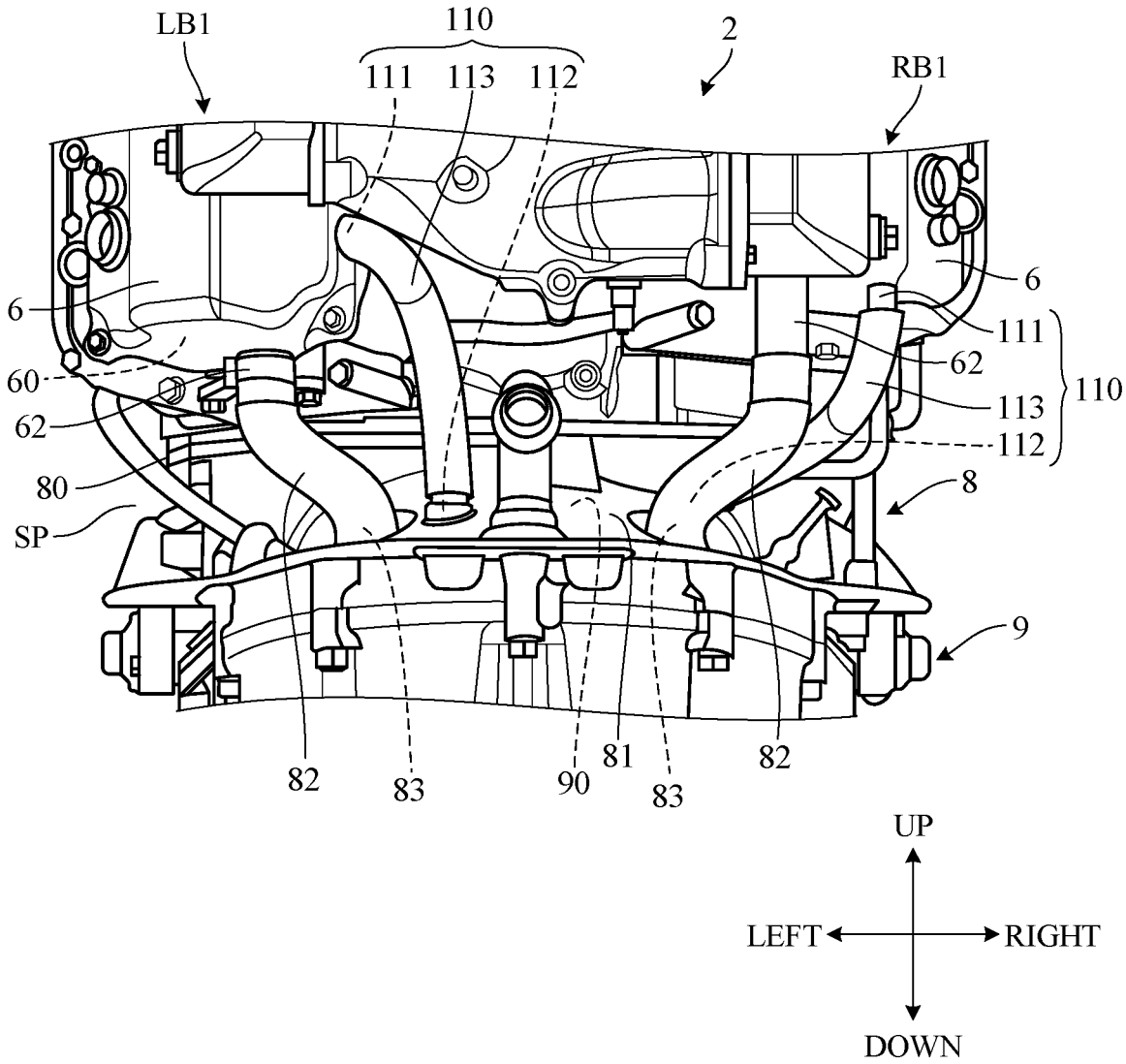
FIG. 5 is a view schematically illustrating a breather communication tube provided in the engine shown in FIG. 2.

FIG. 5 is a view schematically illustrating a breather communication tube 110 provided in the engine 2. As illustrated in FIG. 5, the breather communication tube 110 includes a first communication portion 111 provided in a lower portion of the cylinder head cover 6 of each of the banks RB1 and LB1, a second communication portion 112 provided in the extending portion 81 of the mount case 8, and a communication tube body 113. The communication tube body 113 has one end connected to the first communication portion 111 and the other end connected to the second communication portion 112.

As illustrated in FIGS. 4 and 5, the first communication portion 111 is formed in a tubular shape and penetrates the cylinder head cover 6, and causes the cam chamber 60 inside the cylinder head cover 6 and the inside of the communication tube body 113 to communicate with each other in a state where the communication tube body 113 is connected.

As illustrated in FIG. 5, the first communication portion 111 of the first bank RB1 is provided on the bottom surface of the cylinder head cover 6. In this case, as illustrated in FIG. 4, the first communication portion 111 is provided such that an upper end 111*a* is positioned above the bottom surface 6*a* inside (cam chamber 60) the cylinder head cover 6. Therefore, even when the lubricating oil in the cam chamber 60 is accumulated on the bottom surface 6*a*, it is possible to prevent the upper end 111*a* of the first communication portion 111 from being blocked by the accumulated oil. The length from the bottom surface 6*a* to the upper end 111*a* of the first communication portion 111 is set such that the lubricating oil does not flow backward from the first communication portion 111 when the outboard motor 1 is tilted up.

As illustrated in FIG. 5, the first communication portion 111 of the second bank LB1 is provided on the lower side surface of the cylinder head cover 6. In this case, the first communication portion 111 is provided such that the entire first communication portion 111 including the upper end 111*a* is positioned above the bottom surface 6*a*. In this case, the attachment position of the first communication portion 111 to the cylinder head cover 6 is set such that the lubricating oil does not flow backward from the first communication portion 111 when the outboard motor 1 is tilted up.

As illustrated in FIG. 5, the second communication portion 112 is formed in a tubular shape and penetrates the mount case 8 (extending portion 81), and causes the oil reservoir space 90 below the mount case 8 and the inside of the communication tube body 113 to communicate with each other in a state where the communication tube body 113 is connected.

The first communication portion 111 and the second communication portion 112 are formed in the lower portion of the cylinder head cover 6 and the extending portion 81 of the mount case 8, respectively, such that at least a part of the communication tube body 113 is inclined with respect to the horizontal direction when the outboard motor 1 is tilted up. Since at least a part of the communication tube body 113 is inclined when the outboard motor 1 is tilted up, it is possible to prevent oil from accumulating inside the communication tube body 113 and to secure the air permeability of the communication tube body 113.

The first communication portion 111 and the second communication portion 112 are formed in the lower portion of the cylinder head cover 6 and the extending portion 81 of the mount case 8, respectively, such that the communication tube body 113 of the first bank RB1 and that of the second bank LB1 can be formed of components having the same shape. In this case, since the communication tube body 113 for the first bank RB1 and the communication tube body 113 for the second bank LB1 can be a common component, it is possible to prevent a failure due to, for example, an erroneous attachment between the communication tube body 113 for the first bank RB1 and the communication tube body 113 for the second bank LB1.

As illustrated in FIGS. 2 and 5, the breather communication tube 110 is disposed in an open space SP that is not utilized between the cylinder head 5 and the cylinder head cover 6 of each of the banks RB1 and LB1 and the extending portion 81 of the mount case 8, and causes the oil reservoir space 90 and the cam chamber 60 to communicate with each other. The blow-by gas flowing into the oil reservoir space 90 is introduced into the cam chamber 60 of each of the banks RB1 and LB1 not via the breather passage of the engine body 2*a*, which is a cast component, but via the breather communication tube 110 disposed in the open space SP, and therefore it is possible to avoid an increase of the size of the engine 2.

As illustrated in FIG. 4, the blow-by gas introduced into the cam chamber 60 through the breather communication tube 110 circulates in the cam chamber 60 along the gas flow passage 64 similarly to the blow-by gas introduced into the cam chamber 60 through the conventional breather passage, and is discharged from the cam chamber 60 via the first connection portion 61. In the process in which the blow-by gas circulates through the gas flow passage 64, the lubricating oil contained in the blow-by gas is separated and removed by gravity, and is discharged from the cam chamber 60 via the second connection portion 62. The blow-by gas from which the lubricating oil has been removed is introduced into the air intake device 7 via the breather tube 73 that causes the cam chamber 60 and the air intake device 7 to communicate with each other, and is taken into the engine 2 together with outside air. The lubricating oil separated from the blow-by gas is returned to the oil pan 9 via the oil return tube 82. This makes it possible to purify both the blow-by gas introduced into the air intake device 7 and the lubricating oil returned to the oil pan 9.

The present embodiment can achieve advantages and effects such as the following:

(1) The engine 2 includes: the crankcase 3 housing the crankshaft 31 extending in the vertical direction; the cylinder block 4 mounted on a side of the crankcase 3 and formed with the cylinders 40; the cylinder head 5 mounted on a side of the cylinder block 4 and provided with air inlet ports 51 and the air outlet ports 52 communicating with the cylinders 40; the cylinder head cover 6 mounted on a side of the cylinder head 5 and covering the air inlet ports 51 and the air outlet port 52; the mount case 8 including: the supporting portion 80 provided below the crankcase 3 and the cylinder block 4 and supporting the crankcase 3 and the cylinder block 4; and the extending portion 81 extending from the supporting portion 80 below the cylinder head 5 and the cylinder head cover 6; the oil pan 9 provided below the mount case 8 and storing the lubricating oil; and the breather communication tube 110 communicating the cam chamber 60 formed between the cylinder head 5 and the cylinder head cover 6 and the oil reservoir space 90 formed between the mount case 8 and the oil pan 9 (FIG. 2). The breather communication tube 110 is provided between the cylinder head cover 6 and the extending portion 81 (FIG. 2 and FIG. 5).

This configuration makes it possible to directly discharge gas from the oil reservoir space 90 below the mount case 8 to the cam chamber 60 inside the cylinder head cover 6 of each of the banks RB1 and LB1, and therefore, for example, even in the engine 2 having a large output, it is not necessary to increase the cross-sectional area of the breather passage provided in the engine body 2*a*. Therefore, it is possible to suppress the horizontal length of the cylinder block 4 from increasing, and as a result, it is possible to suppress the size of the engine 2 from increasing. Since the engine can be downsized, cost reduction and weight reduction can be expected. Furthermore, by providing the breather communication tube 110, it becomes possible to lower the position of the center of gravity as compared with the conventional case, and it is possible to suppress the sound, vibration, and the like of the outboard motor 1.

(2) The breather communication tube 110 is arranged in the open space SP formed below the cylinder head cover 6 and the cylinder head 5, and above the extending portion 81 of the mount case 8 (FIG. 2 and FIG. 5). This configuration makes it possible to effectively utilize the open space SP, and it is possible to suppress an increase in size of the engine 2 due to the provision of the breather communication tube 110. By disposing the breather communication tube 110 in the open space SP, a degree of freedom in attaching the breather communication tube 110 increases, and for example, adjustment of an attachment posture of the communication tube body 113 in the assembly process of the engine 2 becomes easy.

(3) The first communication portion 111 of the breather communication tube 110 penetrates the cylinder head cover 6, and the upper end 111*a* of the first communication portion 111 is located above the bottom surface 6*a* of the cam chamber 60 (FIG. 4). With this configuration, even when the lubricating oil is accumulated on the bottom surface 6*a* inside (cam chamber 60) the cylinder head cover 6, it is possible to prevent the upper end 111*a* of the first communication portion 111 from being blocked by the accumulated oil.

(4) The engine 2 further includes: the air intake device 7 configured to introduce the outside air into the air inlet ports 51; and the breather tube 73 communicating the cam chamber 60 and the air intake device 7 (FIG. 3). The cylinder head cover 6 includes the gas flow passage 64 configured to guide the blow-by gas introduced into the cam chamber 60 through the first communication portion 111 of the breather communication tube 110 so as to be discharged from the cam chamber 60 through the breather tube 73 (FIG. 4). This configuration makes it possible to suitably circulate the blow-by gas introduced into the cam chamber 60 via the breather communication tube 110 and discharged from the cam chamber 60 via the breather tube 73.

(5) The gas flow passage 64 incudes the first to third partition walls 64*a* to 64*c* erected from the inner wall surface of the cylinder head cover 6 in the horizontal direction (FIG. 4). The first to third partition walls 64*a* to 64*c* respectively extend in the vertical direction and are provided substantially parallel to each other (FIG. 4). Due to this, the lubricating oil contained in the blow-by gas is separated by gravity in the process in which the blow-by gas circulates through the gas flow passage 64, and it is possible to suppress the lubricating oil from being introduced into the air intake device 7 via the breather tube 73 (FIG. 3).

(6) The engine 2 is a V-type multi-cylinder engine including a pair of banks RB1, LB2 (FIG. 3). The breather communication tube 110 communicates the cam chamber 60 of each bank RB1, LB1 and the oil reservoir space 90 respectively (FIG. 5). This configuration makes it possible to suppress an increase of the size of the engine 2 and to downsize the engine even in a V-type multi-cylinder engine (six-cylinder engine in the present embodiment), and therefore cost reduction and weight reduction can be expected.

(7) The engine 2 is mounted on the outboard motor 1 mounted on the stern of the hull 101 of the boat 100 such as a small boat (FIG. 1 and FIG. 2). The crankshaft 31 extends in the vertical direction with the outboard motor 1 tilted down (FIG. 2). The breather communication tube 110 includes an inclined portion inclined with respect to the horizontal direction in the communication tube body 113 with the outboard motor 1 tilted up (FIG. 2 and FIG. 5). This configuration makes it possible to prevent oil from accumulating inside the communication tube body 113 and to secure the air permeability of the communication tube body 113.

(8) The communication tube body 113 of the breather communication tube 110 of the first bank RB1 and the communication tube body 113 of the breather communication tube 110 of the second bank LB1 are the same in shape (FIG. 5). With this configuration, since the communication tube body 113 for the first bank RB1 and the communication tube body 113 for the second bank LB1 can be a common component, it is possible to prevent a failure due to, for example, an erroneous attachment between the communication tube body 113 for the first bank RB1 and the communication tube body 113 for the second bank LB1.

(9) The outboard motor 1 includes: the engine 2; and the propeller 23 driven by the engine 2 to rotate (FIG. 1 and FIG. 2). By downsizing the engine 2, it is possible to downsize the outboard motor 1.

(10) The boat 100 includes: the outboard motor 1; and the hull 101 mounted with the outboard motor 1 (FIG. 1 and FIG. 2). With this configuration, by downsizing the outboard motor 1, it is possible to attach more outboard motors 1 to the stern of the hull 101.

In the above embodiment, the mount case 8 and the oil pan 9 are described as separate members, but the mount case and the oil pan may be provided integrally. In other words, an oil pan having a function of a mount case may be used. In this case, it is not necessary to separately provide the mount case 8, and the configuration of the entire engine can be simplified.

In the above embodiment, the V-type six-cylinder engine has been described, but the engine is not limited thereto. For example, a V-type multi-cylinder engine other than a six-cylinder engine may be used.

In the above embodiment, the example has been described in which the breather communication tube 110 is disposed such that at least a part of the communication tube body 113 is inclined with respect to the horizontal direction in the state where the outboard motor 1 is tilted up. However, the breather communication tube 110 is preferably disposed such that at least a part of the communication tube body 113 is inclined with respect to the horizontal direction also in the process where the outboard motor 1 is trimmed up stepwise from the state of being tilted down to the state of being tilted up.

The above embodiment can be combined as desired with one or more of the above modifications. The modifications can also be combined with one another.

According to the present invention, it becomes possible to downsize the engine.

Above, while the present invention has been described with reference to the preferred embodiments thereof, it will be understood, by those skilled in the art, that various changes and modifications may be made thereto without departing from the scope of the appended claims.

What is claimed is:

1. An engine, comprising:

a crankcase housing a crankshaft extending in a vertical direction;

a cylinder block mounted on a side of the crankcase and formed with a cylinder;

a cylinder head mounted on a side of the cylinder block and provided with an air inlet port and an air outlet port communicating with the cylinder;

a cylinder head cover mounted on a side of the cylinder head and covering the air inlet port and the air outlet port;

a mount case including:

a supporting portion provided below the crankcase and the cylinder block and supporting the crankcase and the cylinder block; and an extending portion extending from the supporting portion below the cylinder head and the cylinder head cover;

an oil pan provided below the mount case and storing lubricating oil; and a communication tube communicating a first space formed between the cylinder head and the cylinder head cover and a second space formed between the mount case and the oil pan, wherein the communication tube is provided between the cylinder head cover and the extending portion, wherein the engine is a V-type multi-cylinder engine including a pair of banks, wherein the communication tube communicates the first space of each bank of the pair of banks and the second space respectively, wherein the pair of banks is a first bank and a second bank, wherein the communication tube of the first bank and the communication tube of the second bank are same in shape.

2. The engine according to claim 1, wherein the communication tube is arranged in a third space formed below the cylinder head cover and the cylinder head, and above the extending portion.

3. The engine according to claim 1, wherein the communication tube penetrates the cylinder head cover, wherein an upper end of the communication tube is located above a bottom surface of the first space.

4. The engine according to claim 1, further comprising:

an air intake device configured to introduce outside air into the air inlet port; and a breather tube communicating the first space and the air intake device, wherein the cylinder head cover includes a flow passage configured to guide gas introduced into the first space through the communication tube so as to be discharged from the first space through the breather tube.

5. The engine according to claim 4, wherein the flow passage includes a plurality of partition walls erected from an inner wall surface of the cylinder head cover in a horizontal direction, wherein the plurality of partition walls respectively extend in the vertical direction and are provided substantially parallel to each other.

6. The engine according to claim 1, wherein the engine is mounted on an outboard motor mounted on a stern of a hull of a small boat, wherein the crankshaft extends in the vertical direction with the outboard motor tilted down, wherein the communication tube includes an inclined portion inclined with respect to a horizontal direction with the outboard motor tilted up.

7. The engine according to claim 1, wherein the mount case and the oil pan are integrally provided.

8. An outboard motor, comprising:

the engine according to claim 1; and a propeller driven by the engine to rotate.

9. A boat, comprising:

the outboard motor according to claim 8; and a hull mounted with the outboard motor.

* * * * *